US005542227A

United States Patent [19]

Frayne

[11] Patent Number: 5,542,227

[45] Date of Patent: Aug. 6, 1996

[54] STRUCTURAL METAL ROOF SYSTEM

[76] Inventor: Clifford G. Frayne, 36 Laurelwyck Dr., Waretown, N.J. 08758

[21] Appl. No.: 453,372

[22] Filed: May 30, 1995

[51] Int. Cl.[6] ..... E04B 1/32

[52] U.S. Cl. ..... 52/639; 52/641; 403/363

[58] Field of Search ..... 52/639, 641, 645; 403/363, 375, 382

[56] References Cited

U.S. PATENT DOCUMENTS

| | | | |
|---|---|---|---|
| 4,389,829 | 6/1983 | Murphy | 52/639 X |
| 5,457,927 | 10/1995 | Pellock et al. | 52/639 X |
| 5,463,837 | 11/1995 | Dry | 52/639 |

*Primary Examiner*—Carl D. Friedman
*Assistant Examiner*—Christopher Todd Kent
*Attorney, Agent, or Firm*—Clifford G. Frayne

[57] ABSTRACT

There is disclosed a metal roof support structure comprised of rafter beams, ceiling beams, and internal structural supports, the aforesaid members overlapping in snap-fit interlocking relationship, the intersection points of each of the aforesaid elements being secured by a single fastener. The rafter beams and ceiling beams are comprised of a structural member adapted to interlock with a second structural member of similar construction to form the rafter beams and ceiling beam, each of which presents an "I" beam cross-section when so assembled.

9 Claims, 9 Drawing Sheets

STRUCTURAL METAL ROOF SYSTEM

BACKGROUND OF THE INVENTION

1. Field of the Invention

The present invention relates to framing systems and, in particular, a structural roof framing system comprised of metal members which are preformed and interlocked to form a roof frame of improved structural integrity and of desired length and pitch.

2. Description of the Prior Art

The majority of residential house framing is accomplished with wood. Most roofing systems with respect to residential housing have in the past been fabricated and constructed of wooden rafters, wooden ceiling beams and, when required, wooden strut members to form the roof frame. Wood was the material of choice because of cost considerations. Attention had been given to fabricating roof systems out of metal, but they normally could not compete with the cost of conventional wooden trusses.

In the past, Murphy in U.S. Pat. No. 4,389,829 and 4,201,026 and U.S. Pat. No. 4,192,119 and U.S. Pat. No. 4,188,147 directed his attention to metal structural members which could be utilized in the construction industry and, in particular, for conventional housing.

Similarly, Madray in U.S. Pat. No. 4,551,957 has directed his attention to the construction of a structure utilizing metal structural members.

Murphy, in his U.S. Pat. No. 4,389,829, discloses a metal roofing system in which the rafter and the purlin or ceiling beam are secured together by a plurality of truss or web members. Similarly, Madray in U.S. Pat. No. 4,551,957 discloses a roof structure comprised of metal members in conjunction with his overall metal frame for a building.

A major shortcoming with respect to structural framing with respect to metal prefabricated members is the fact that the alignment and joining of the members could not always be accomplished in a manner to ensure structural integrity. Madray requires a plurality of specialized angle pieces as disclosed in FIGS. 10 through 21 to connect the various metal structural elements of his frame. These angle pieces contain a plurality of apertures for the receipt of fasteners. The plurality of fasteners used at each joint is required to ensure that the structural integrity can hopefully be achieved. However, there is no guarantee that either a majority or perhaps a minority of the fasteners are in effect in proper position with respect to the intersecting structural metal elements of the frame. These shortcomings also relate to the teachings of Murphy who discloses certain specialized pin arrangements to secure various structural members.

Interest in structural metal elements for framing is gaining new interest in light of environmental laws, increased demand and decreased supply which have greatly escalated the cost and reduced the quality of lumber used in house framing. Additionally, certain building codes, particularly in the south, have increased the cost of constructing or framing with lumber due to certain weather phenomena particular to the southern United States. As such, framing with metal structural elements can now compete with traditional wood and lumber framing from a cost effective standpoint.

Applicant has improved upon the teachings of Murphy to provide for a more secure metal roof structure in which the members interlock and are positively secured at each interlocking point by a single fastener. Applicant's design provides for a lightweight, yet sturdy roof frame, the elements of which can be preformed and packaged as in a kit, so that a contractor need only specify the length and pitch of the roof required and a kit containing all of the elements for such a truss or standard ceiling beam and rafter can be provided.

OBJECTS OF THE INVENTION

An object of the present invention is to provide for a novel roof system of interlocking metal components.

Another object of the present invention is to provide for a novel roof frame comprised of interlocking metal components providing a sturdy roof truss, yet light in weight.

A still further object of the present invention is to provide for a novel roof truss comprised of interlocking metal components wherein the interlocking metal components are fastened at each interlocking point with a novel fastener.

A still further object of the present invention is to provide for a novel roof truss which can be preformed to any desirable length and pitch of the roof.

A still further object of the present invention is to provide for a novel roof truss comprising metal components which can be preformed and sold in kit form for any desired length and pitch of the roof.

A still further object of the present invention is to provide for a novel roof frame for low rise structures using conventional ceiling beam, rafter, and collar beam framing as is currently practiced by the conventional wood framing industry.

A still further object of the present invention is to insert these innovations into the existing metal "C" stud industry, thereby improving same.

A still further object of the present invention is to expand on these innovations to include the other structural elements of a building, such as a wall and floor systems.

SUMMARY OF THE INVENTION

A metal roof support structure comprised of rafters, ceiling beam, and internal structural supports, the aforesaid members overlapping in snap-fit interlocking relationship, the intersection points of each of the aforesaid elements being secured by a single fastener. The rafters and ceiling beam are comprised of a structural member adapted to interlock with a second structural member of similar construction to form the rafter and ceiling beam, each of which presents an "I" beam cross-section when so assembled.

BRIEF DESCRIPTION OF THE DRAWINGS

These and other objects of the present invention will become evident when considered with respect to the following illustrations.

DETAILED DESCRIPTION OF THE DRAWINGS

Figure 1:
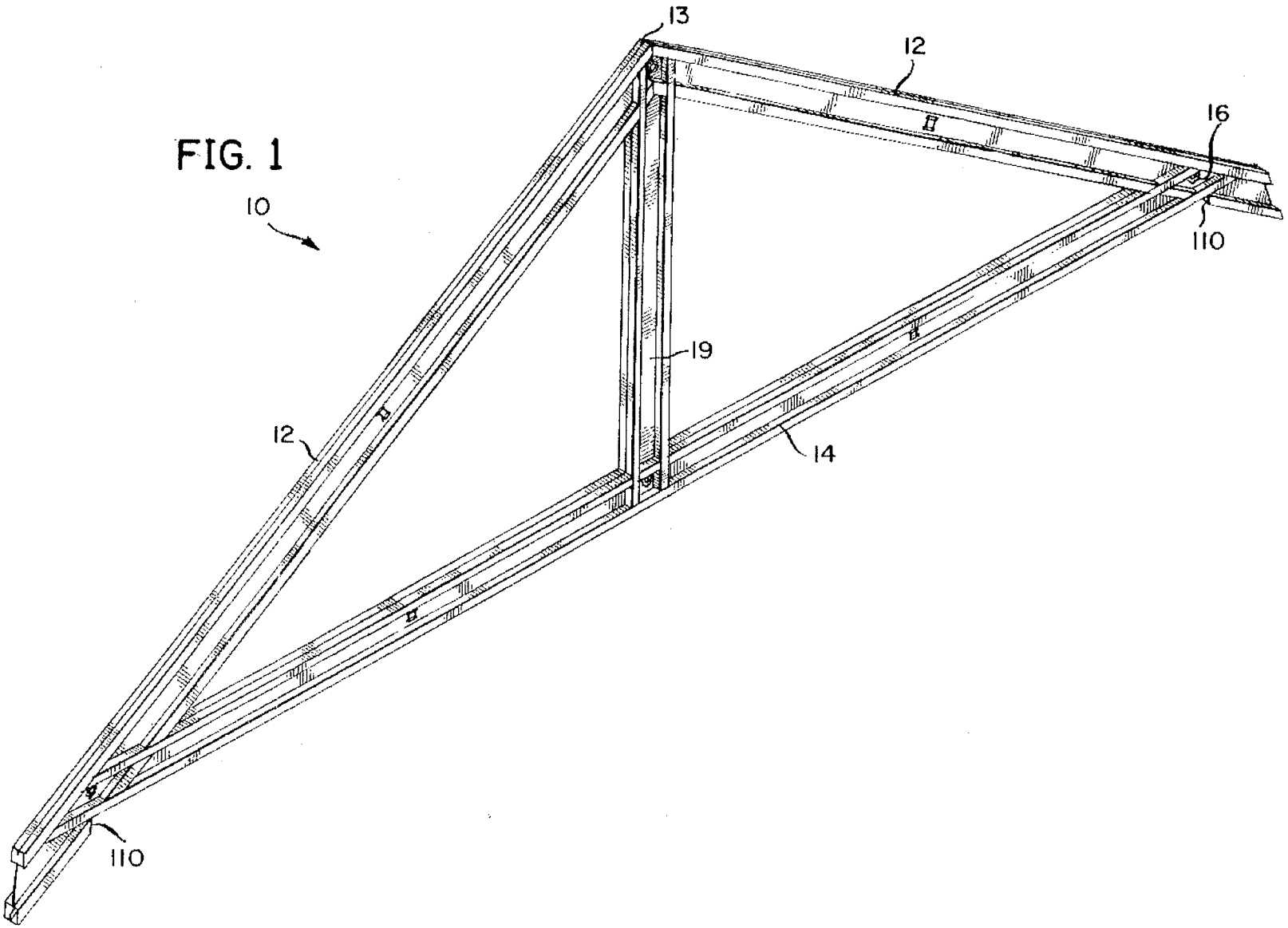
FIG. 1 is a perspective view of a roof support employing a king post support.
Figure 2:
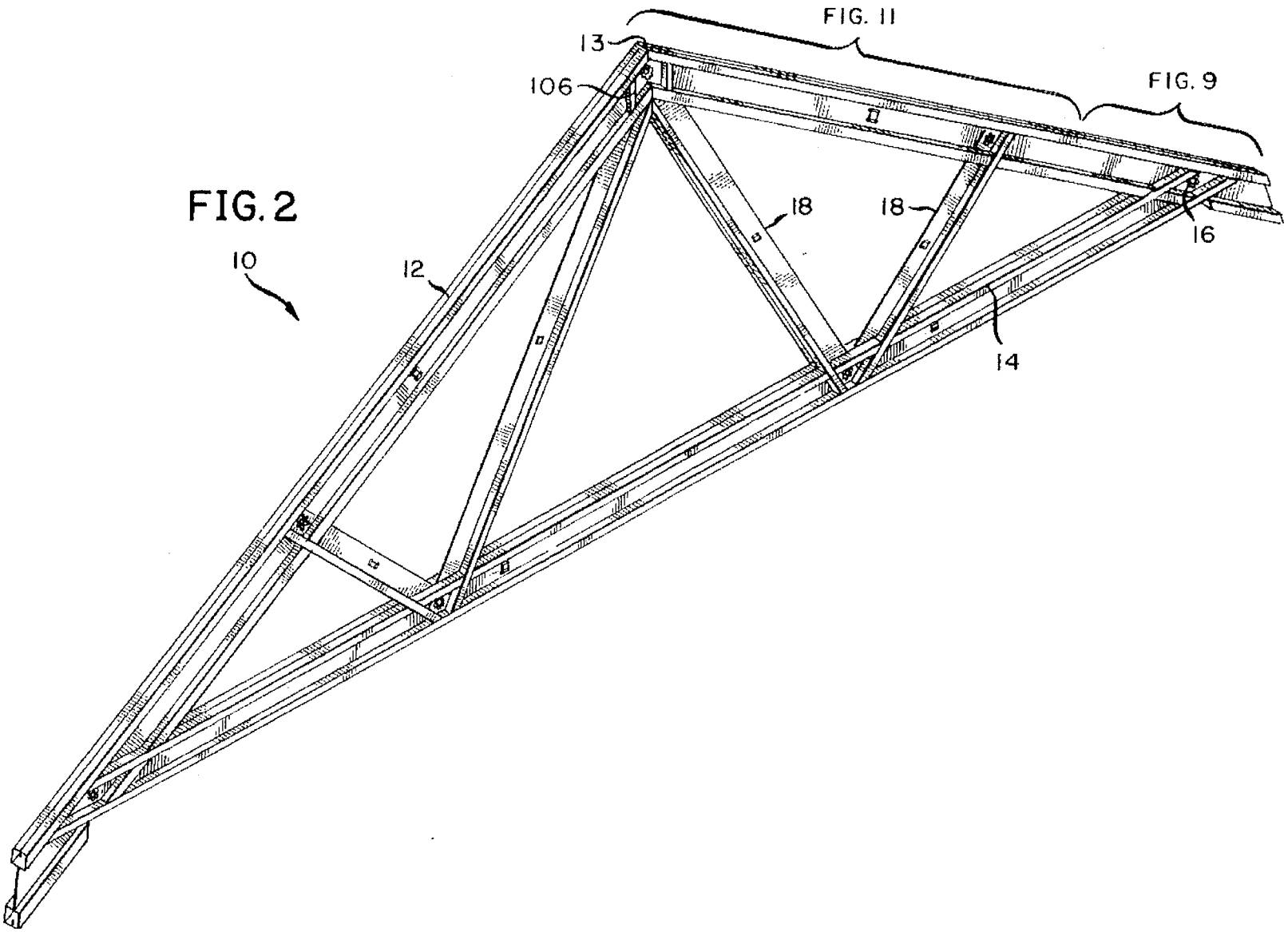
FIG. 2 is a perspective view of a roof support employing angular struts.

Referring to FIG. 1, there is illustrated a roof support system, generally referenced 10, employing sheet metal members that are interconnected to provide a structurally secure, high strength assembly. The system includes a plurality of rafters 12 that are interconnected to each other at an apex 13, and are secured to ceiling beams 14 proximate their opposing end 16. Additional structural support is provided by means of strut members 18 which interconnect between the rafter and the ceiling beam in angular relationship. FIG. 1 illustrates a roof support system which also incorporates a king post 19 which interconnects from the ceiling beam 14 and the apex point 13 where rafters 12 are interconnected. FIG. 2 illustrates a perspective view of a more conventional roof support system with the absence of a king post.

Figure 3:
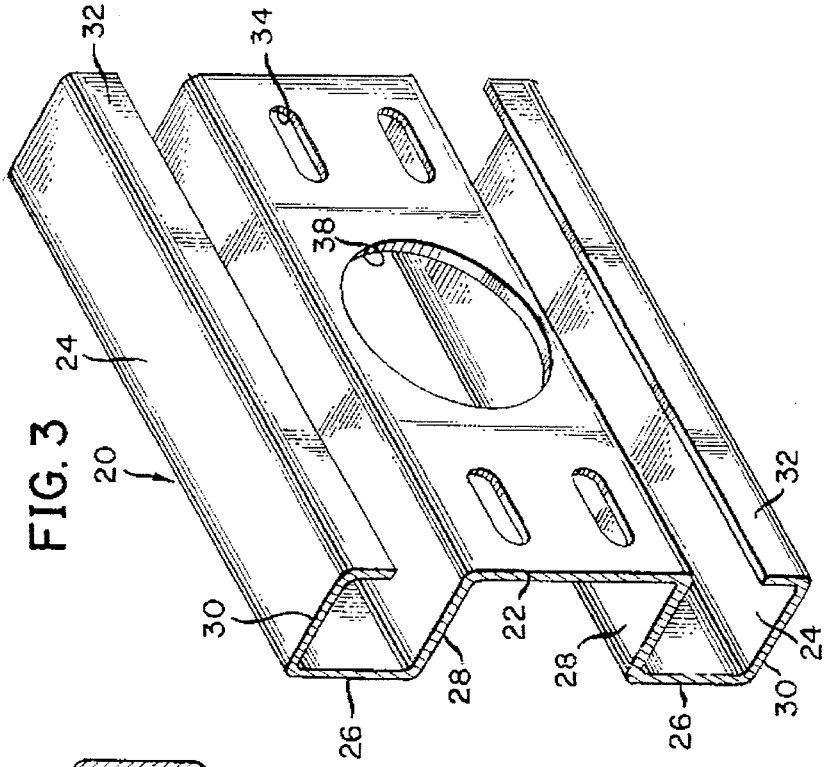
FIG. 3 is a partial perspective view of the structural member illustrating the web and flange portions.

Rafters 12 and ceiling beams 14 are formed by bringing together two structural members of the type described in U.S. Pat. No. 4,192,119 and further in U.S. Pat. No. 4,389,829 to form a beam. FIG. 3 illustrates that each structural member 20 includes an elongated web 22 having two end flanges 24 projecting laterally to one side of the web. The flanges 24, which are of similar construction, are generally rectangular in form and are open to the opposite side of the web. Preferably the structural member 20 is roll formed from a single strip of material that possesses relatively high strength and resiliency. Each rectangular flange 24 includes a bottom wall or base 26 which is positioned in parallel alignment with the web. The base is connected to the longitudinal edge of the web by means of an inner sidewall 28 that is normal to the plane of the web. A second outer sidewall 30 depends upwardly from the outer edge of the base. The outer sidewall 30 is positioned in parallel alignment with the inner sidewall and terminates in the plane of the web. A lip 32 depends inwardly from the distal end of the outer wall and is located in coplanar relationship with the web.

Figure 4:
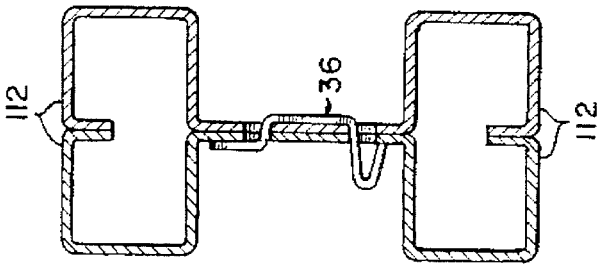
FIG. 4 is a cross-sectional view of two structural member combined.

The web 22 will have a plurality of apertures 34 along its length, alignable with similar apertures in the identical structural member such that a securing means in the form of a pin 36 can be inserted, thus securing two identical structural members together along their web portion to form an "I" beam in cross-sectional area (see FIG. 4). Additionally, the webs will have positioned and alignable along their length, a plurality of larger apertures 38 for receipt of the fastening means utilized at each intersecting point of the roof support system to secure overlapping structural members as described hereafter.

Figure 5:
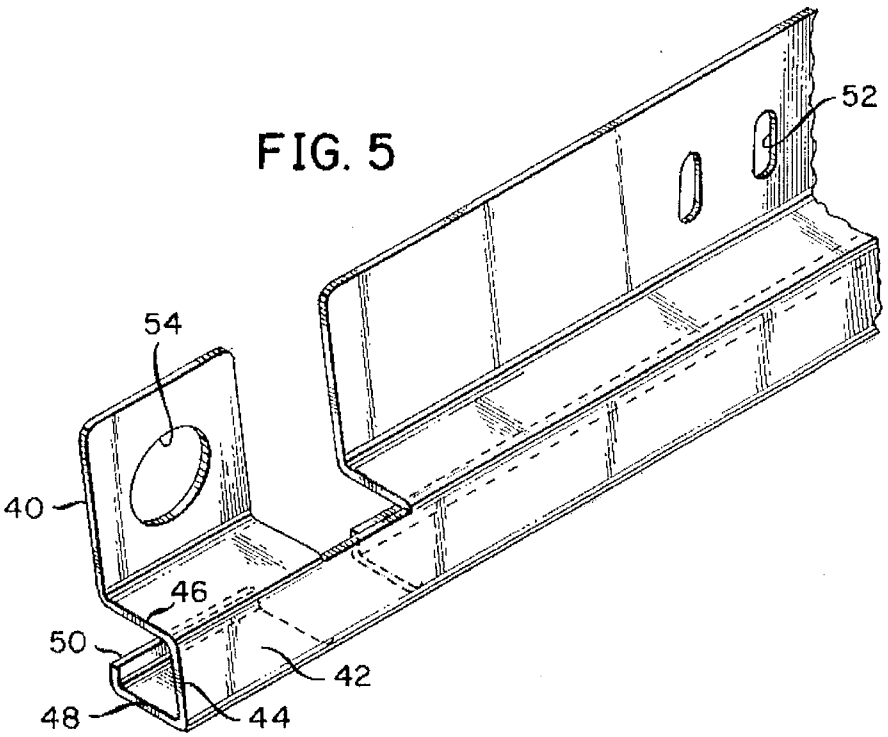
FIG. 5 is a perspective view of a portion of a strut member.

The strut members 18 which interconnect between rafter 12 and ceiling beam 14 are also roll formed from sheet metal so as to possess relatively high strength. The strut member 18 as originally formed is similar to structural member 20 in that, as illustrated in FIG. 5, it comprises an elongated web 40, but has only one end flange 42 projecting laterally from one side of the web. End flange 42 is similar to end flange 24 found on the rafter and ceiling beam in that it has a bottom wall or base 44 which is positioned in parallel alignment with the web 40. The base is connected to the longitudinal edge of the web by means of an inner sidewall 46 that is normal to the plane of the web. A second outer sidewall 48 depends upwardly from the outer edge of the base. The outer sidewall is positioned in parallel alignment with the inner sidewall and terminates in the plane of the web. A lip 50 depends inwardly from the distal end of the outer wall and is located in coplanar relationship with the web.

The web 40 will have a plurality of apertures 52 along its length alignable with similar apertures in an identical structural strut member such that a securing means in the form of a pin 36, identical to the pin utilized to secure the rafters and purlins, can be inserted, thus securing two identical strut members together along their web portion to form a "T" beam in cross-sectional area. Additionally, the webs will have positioned proximate its ends, a larger aperture 54 for receipt of the fastening means utilized in each intersecting point of the roof support system to secure overlapping structural members as described hereafter.

As is illustrated in FIG. 2, the strut members vary in length based upon the length or span of the ceiling beam 14 and the desired pitch of the roof. In order to accomplish the necessary interlocking with the ceiling beam and rafter, it is necessary that certain cuts be made in the strut members to allow for such interlocking. These cuts would be made proximate to the ends of each strut member. It is desirable that there be symmetry between the apex 13 where rafters 12 are interconnected and the interconnection of the rafters 12 and ceiling beam 14 which occurs at point 16. Good building practice will dictate the number of strut members required for each roof support. FIGS. 1 and 2 represent a roof support of modest length of approximately 18 to 20 feet. Any increase in length of the roof support distance along ceiling beam 14 may require additional strut members and/or widening web 22 and/or varying the gauge of the metal as discussed hereafter. It will become evident from the following description, that the strut members are all identical with the exception of their length and the aforementioned required cuts, thus, if a length of ceiling beam and a pitch of roof is specified, not only the rafters and ceiling beam can be preformed and cut, but all of the necessary strut members required for such a roof support can be preformed and cut, such that a single roof support system with all necessary elements and fasteners can be packaged and designated in kit form for either on site or off site assembly.

Figure 8:
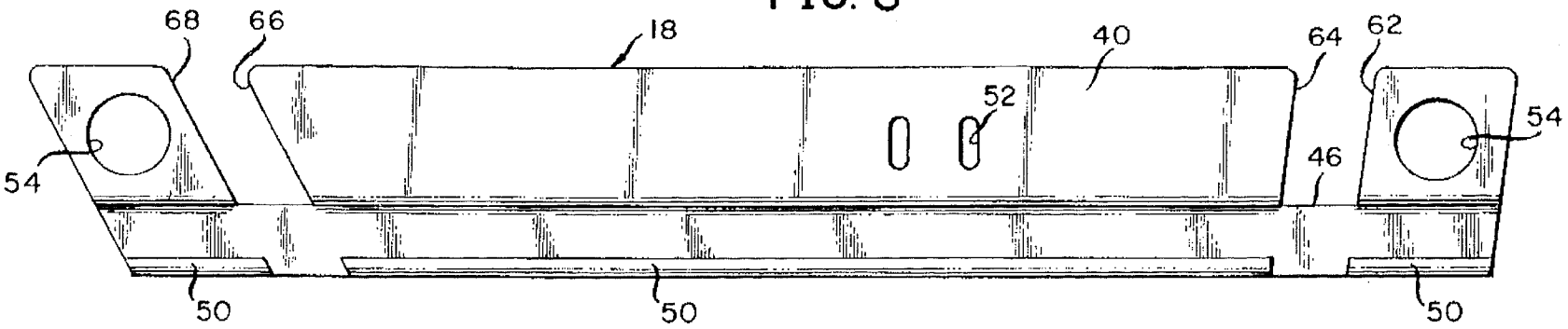
FIG. 8 is a rear view of a strut member.
Figure 6:
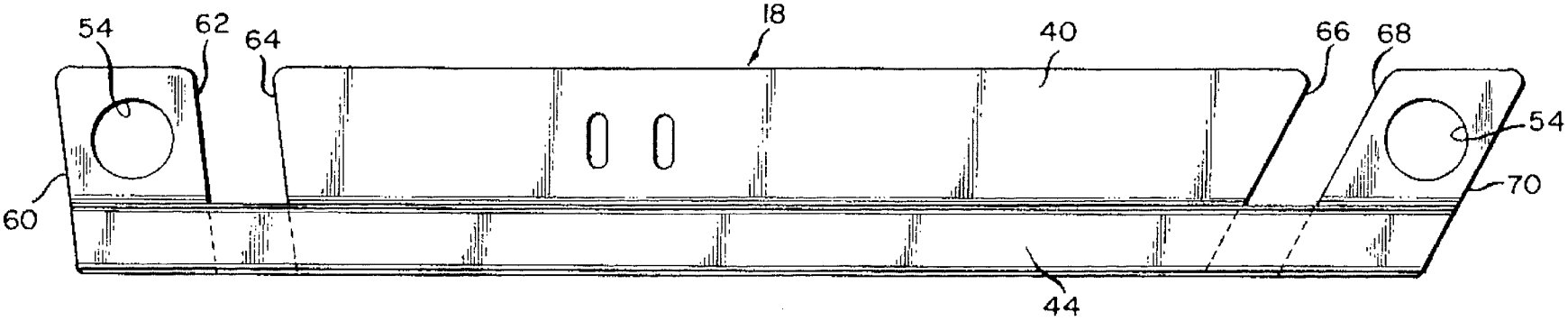
FIG. 6 is a front view of a strut member.
Figure 7:
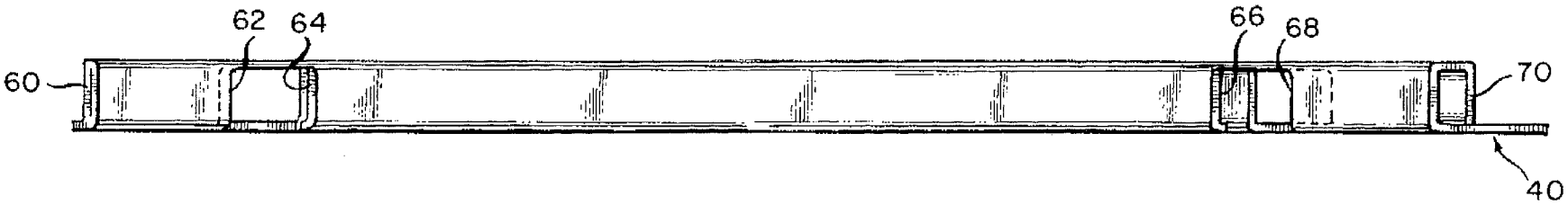
FIG. 7 is a top view of a strut member.

For purposes of explanation, FIGS. 6, 7 and 8 represent a front, top and rear view of a strut member 18 with appropriate cuts having been made. FIG. 6 is a front view of a typical strut member 18. Strut member 18 has been cut in six distinct locations. On first end 60, both the web 40 and end flange 42 have been cut on a predetermined angle from the vertical. A second and third cut 62 and 64 have been made on the inside of aperture 54, these cuts have included the web 40, inner sidewall 46 of end flange 42 and outer sidewall 48 and lip 50 of flange 42. Reference to FIG. 8 will illustrate this cut from a rear view.

The next cuts 66 and 68 are made at the opposing end 30 of strut member 18 and again are made inside of aperture 54. These cuts again are through web 40, inner sidewall 46 and outer sidewall 48 and lip 50 of flange 42 and again may best be viewed with respect to FIG. 8. The final cut on strut member 18 is made at end 70.

The cuts at 62 and 64 form a snap-fit interlocking channel as do the cuts at 66 and 68. The angle of these cuts will vary from strut member to strut member depending upon its length and its positioning in the roof support and the roof pitch. However, the angle of the cuts at each end of the strut member, 60 or 70, will be equal to the angle of the cuts of the associated channel formed proximate to the respective end. In other words, the angle cut at 60 is at the same angle as 62 and 64 and the angle cut at 70 is at the same angle as the cut at 66 and 68. In certain instances, the angle cut at all six locations might be identical, but more often than not, the angle cut at one end of the strut member will be different from the angle cuts at the opposing end of the strut members. FIG. 7 is a top elevational view of a strut member 18 having experienced the necessary cuts required for permitting it to become snap-fit and interlocking with the rafters 12 and ceiling beams 14.

The location of the cuts in strut member 18, their dimensions, and their angularity, are interrelated with rafter members 12 and or ceiling beams 14. The distance from cut 62 to 64 is equal to the dimensional width of an end flange 24 of structural member 20. Similarly, the distance between cuts 66 and 68 is also equal to the dimensional width of a flange 24 on structural member 20. The distance along the web 40 from cut 60 to cut 62 on strut member 18 is identical to the width of web 22 on structural member 20, and similarly, the distance from cut 70 to cut 68 on web 40 is equal to the width of web 22 on structural member 20.

Figure 9:
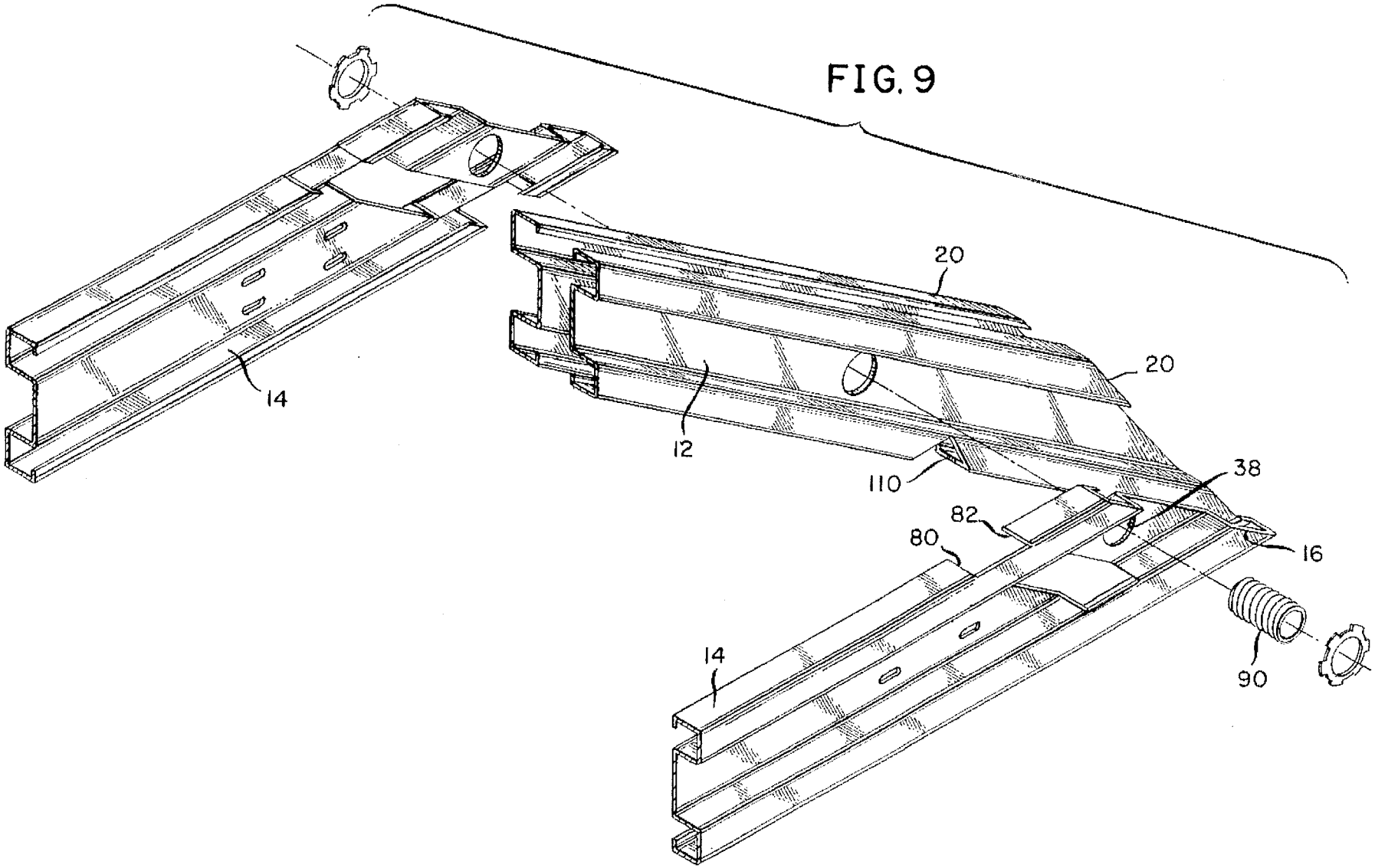
FIG. 9 is a partial, perspective, exploded view of the rafter and ceiling beam.

Referring now to FIG. 9, there is illustrated a partial perspective exploded view of the manner in which the rafter 12 and ceiling beam 14 are secured. The ceiling beam 14 would undergo an angular end cut on its end 16, the angular cut being equal to the slope or pitch of the intended roof. The cut would be made adjacent one of the larger apertures 38 positioned in web 22 of structural member 20. On the opposite side of the adjacent large aperture 38, two additional cuts would be made at 80 and 82. These cuts would be through lip 32, outer sidewall 30, inner sidewall 28 of both flanges 24. The angle of these cuts would be identical to the angle of the cut at 16. The same process would occur on the opposing end of ceiling beam 14. The ceiling beam 14 can then be snap-fit, interlocked with rafter 12. The procedure would be to mate two of the structural members 20 along their respective webs 22 to form a "I" beam in cross-sectional area as illustrated in FIG. 4. Pins 36 would then be inserted at various locations through the web and the result would be a rafter 12. Two structural members 20 having the cuts as just described, would then be positioned, one on each side of rafter 12. That portion of the web 22 and flange 24 surrounding aperture 38 would snap-fit over web 22 of rafter 12 and between flanges 24 of rafter 12, such that end cut 16 would be in intimate contact with inner sidewall 28 of the upper flange of rafter 12 and the channel formed by cuts 80 and 82 would overlap the lower flange of rafter 12. The same procedure would occur with respect to the other structural member 20 of ceiling beam 14, such that when finished, aperture 38 in each of the structural members 20 comprising ceiling beam 14 would be in alignment with apertures 38 in rafter 12. Pins 36 would be positioned in ceiling beam 14 along its web length in the manner previously described. It would then be appropriate to secure this connection with the fastening means which would be cooperative with aligned apertures 38 in ceiling beam 14 and rafter 12.

Figure 10A:
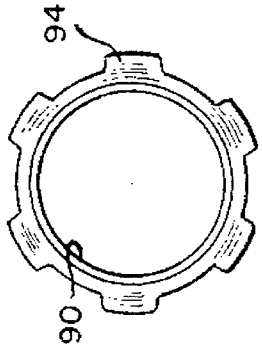
FIG. 10A is a top view of the securing means.
Figure 10:
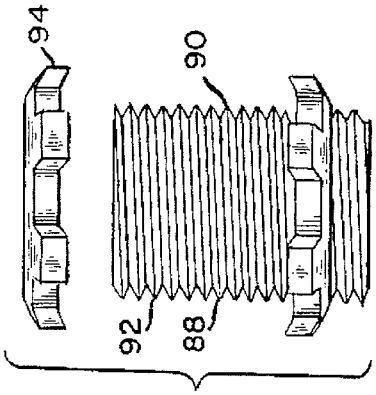
FIG. 10 is a side view of the securing means.

The fastening means utilized with respect to the roof support comprises a single fastening means utilized at each intersecting location of structural members. The use of a single fastening means assures the assembler of a secure contact between all intersecting and interlocking elements. FIG. 10 is a side exploded view and FIG. 10A is a top view of the fastening means 88. It comprises a cylindrical pin or plug 90, the diameter of which is substantially equal to large apertures 38 located in the web 22 of rafters 12 and ceiling beams 14 and large aperture 54 found at opposing ends of strut members 18. The plug 90 is of sufficient length to accommodate a plurality of layers of webbing from the rafters, ceiling beams and strut members on its circumference. The outer circumference 92 of plug 90 is threaded to receive at least one removable nut 94. In practice, plug 90 can be fabricated in several ways. Its entire circumference could be threaded such that two nuts could be tightened from opposing ends of the plug once it had been inserted through the aligned apertures referenced above, or one nut could be permanently non-rotatably affixed to the plug at one end with the opposing end being threaded for the receipt of a second nut for securing structural members. In the alternative, the plug could be fabricated with an annular flange affixed and non-rotatable to serve as a stop with the opposing end of the plug having a threaded portion for receipt of a threaded nut.

Referring back to FIG. 9, and the assembly of the rafter 12 and ceiling beam 14 at point 16, it can be seen that in fabrication of this joint, the rafter 12 is assembled as discussed above, the ceiling beam 14 consisting of two structural elements 20 are snap-fit and interlocked with the rafter thereby aligning apertures 38. The plug 90 is then inserted through the aligned apertures 38 and the threaded nuts 94 are secured to and tightened at opposing ends of the plug by means of a ratchet, wrench or similar tool, thus firmly and positively securing the ceiling beam 14 to the rafter 12 at point 16. It should be noted that at this joint, the plug is securing four layers of web 22.

Figure 11:
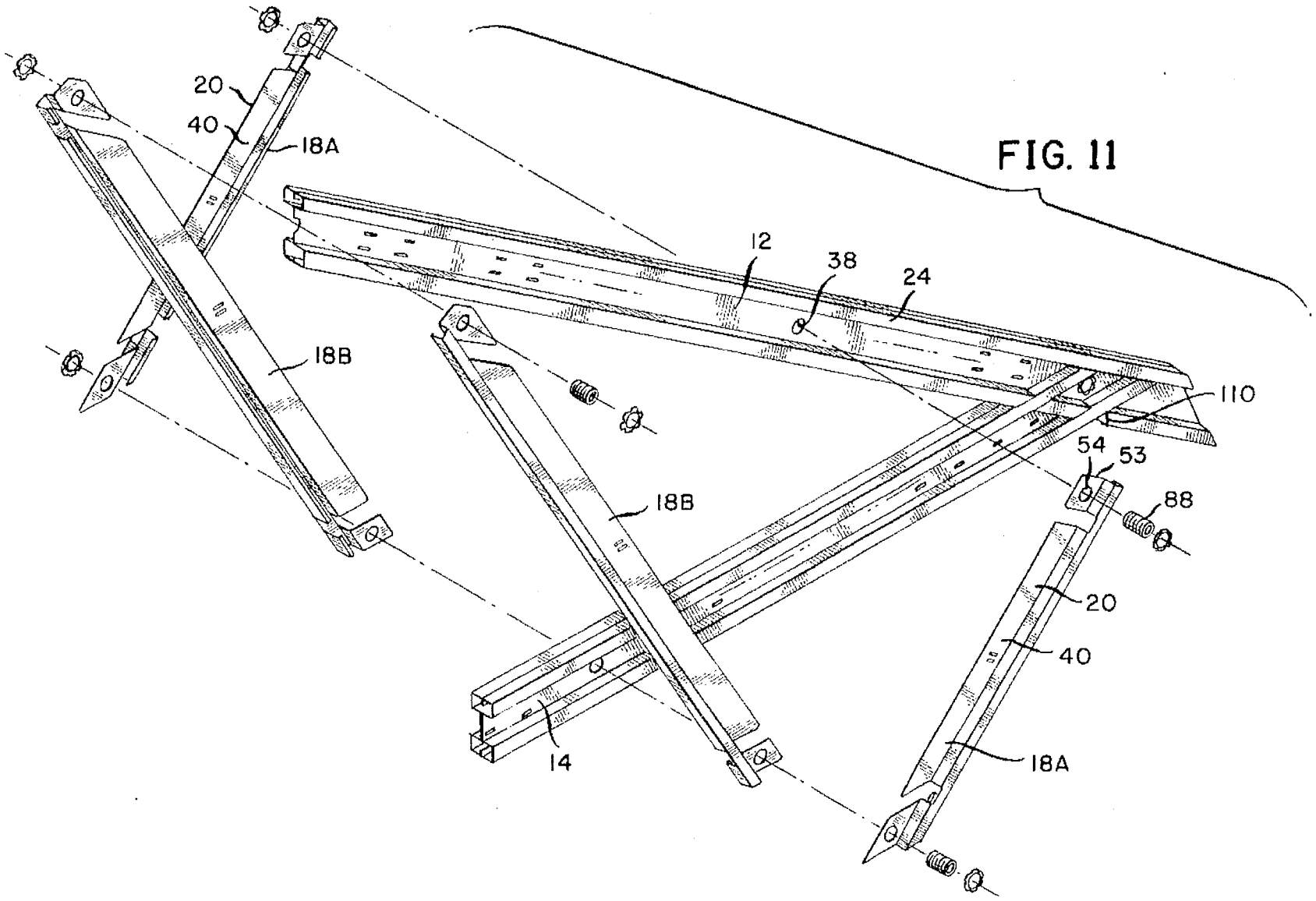
FIG. 11 is a partial, perspective view of the interrelationship of the rafter, ceiling beam and strut members.

Proceeding to FIG. 11, there is disclosed a partial perspective view of a rafter 12, ceiling beam 14 and strut members 18. At this point in the assembly, the rafter 12 would have been secured to the ceiling beam 14 at point 16 and the two rafters would have been joined at the apex 13. The strut members would then be secured between rafter 12 and ceiling beam 14.

For simplicity, we will discuss the installation of two adjacent strut members 18, which we will designate as 18A and 18B, but it will be understood by one of ordinary skill in the art that depending upon the span of the roof, additional strut members may be required and their installation would be in the same manner as described herein. Two strut members 18A would be positioned on opposing sides of rafter 12 with their webs 40 facing towards rafter 12. One end of each of the strut members 18A would snap-fit and interlock between flanges 24 on rafter 12 such that aperture 54 on tab 53 of strut member 18A was in alignment with aperture 38 on rafter 12. In this fashion, the tab 53 on strut member 18 is firmly positioned between the flanges 24 of rafter 12 and in contact with web 22 of rafter 12. Fastener 88 would then be installed at this intersecting position.

The same procedure would be performed simultaneously at the opposing end of first strut member 18A where it adjoined the ceiling beam 14. However, at this opposing end, simultaneously with positioning the first strut member 18A, the second strut member 18B would be positioned in the same manner with its first end being secured to ceiling beam 14 and its second end being secured to rafter 12 in the same fashion. If a third strut member was required, then the same steps would be performed by the assembler with this strut member running from rafter 12 back down to ceiling beam 14.

Still referring to FIG. 11, it will be noted that first strut member 18A, when secured to rafter 12, results in fastener 88 passing through four web thicknesses. At the opposing end of first strut member 18A where it is secured to ceiling beam 14, an additional strut member, second strut member 18B, is also secured at this position resulting in the fastener 88 passing through six layers of web at this particular location and there would similarly be six layers of web at other locations in the roof support wherever two strut members 18 were secured at the same point, either in the rafter or in the ceiling beam. While six or more web layers can be accommodated by fastener 88, restricting the number of web layers to four layers provides for better alignment and lessens the need to work or deform the strut members in order to obtain the proper fit. In order to accomplish this and maintain the structural integrity of the roof support, on many occasions, it is only necessary that one-half of the strut member 18 have tab 53 and aperture 58 at both opposing ends. The other half need only have tab 53 and aperture 38 at one end with the opposing end essentially terminating at either cut 64 or cut 66 as illustrated in FIG. 6 which respective cut would be entirely through the web 40 and flange 44. The same would apply to strut member 18B as illustrated in FIG. 11. In either instance, once the fastener 88 has secured the web members, the assembler would install pins 36 along the web 40 of the strut members.

Figure 12:
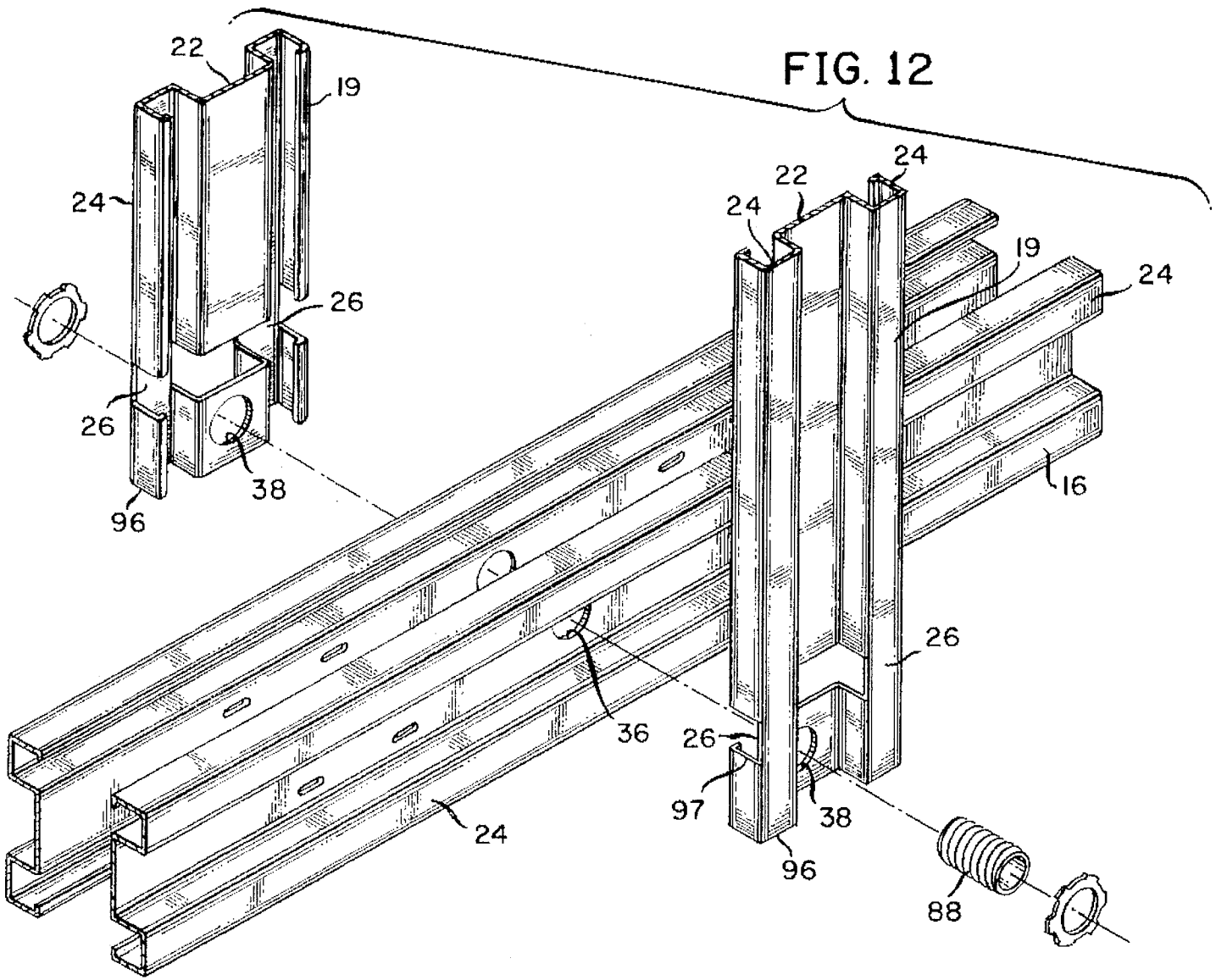
FIG. 12 is a partial, exploded view of the interrelationship of the ceiling beam and king posts.

FIG. 12 is a exploded, blow-up view of the connection of a king post 19 to a ceiling beam 16. The king post would comprise two sections, identical to the two sections which comprise the ceiling beam 16. With ceiling beam 16 secured, the two portions of the king post 19 would be snap fit from opposing sides of ceiling beam 16 and secured by means of fastening means 88. It can be seen from FIG. 12 that the necessary cuts in the king post 19 include a horizontal cut inside of aperture 36 which traverses elongated web 22 and two end flanges 24 leaving intact the bottom wall or base 26 of flanges 24. In this configuration, the cut will snap fit over the upper flange 24 on ceiling beam 16 and bottom end 96 would be in perpendicular contact communication with the lower flange 24 at the inner sidewalls 23 of ceiling beam 16. Fastening means 88 would then pass through apertures 36 in both the king post and the ceiling beam and be secured thereto. The distance from the lower edge 97 of the cut in the king post to the lower end 96 of the king post would be equal to the width of the web 22 in ceiling beam 16.

Figure 13:
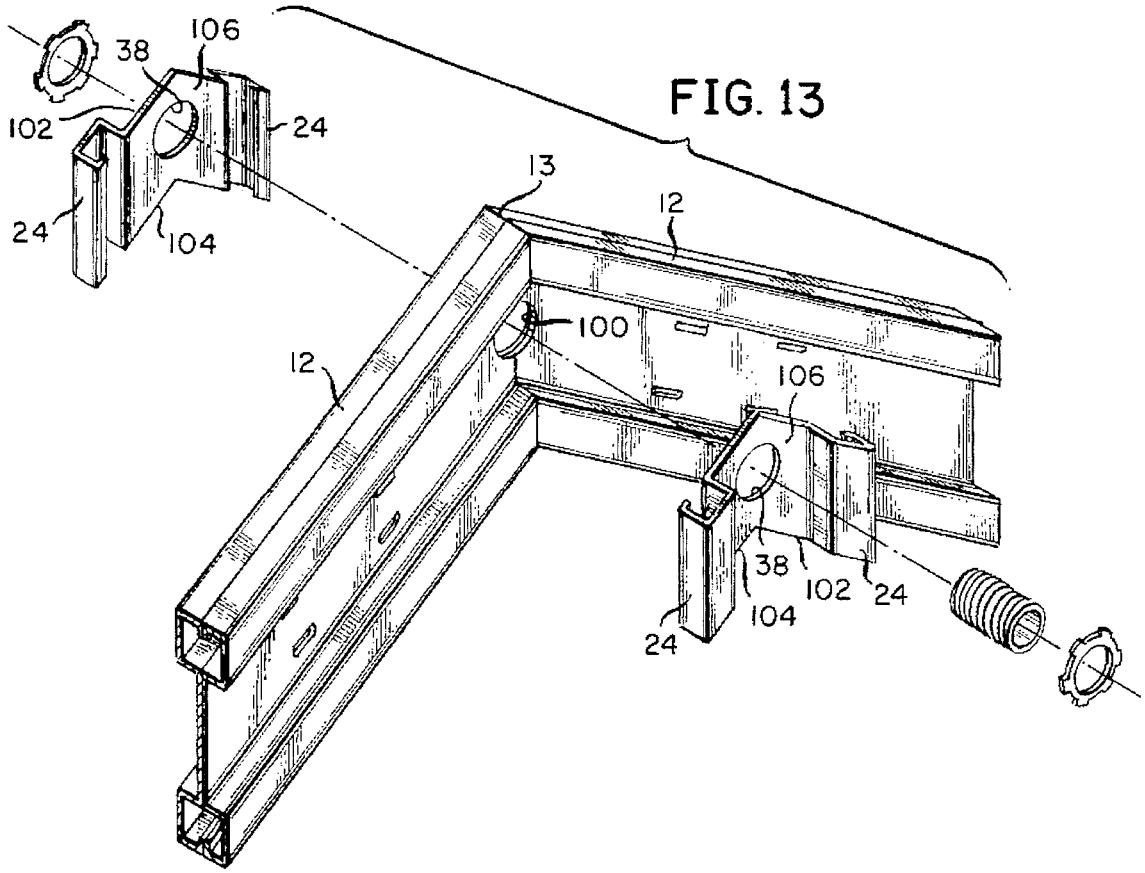
FIG. 13 is a partial, exploded view of the manner of securing rafters at their apex.

FIG. 13 illustrates the manner in which rafters 12 are secured at the apex 13. Rafters 12 would be precut depending upon the pitch desired with respect to the roof, such that when adjoining rafters 12 are positioned at apex 13, an aperture 100 is formed which is identical to preformed aperture 38 formed in rafter members 12. Support chevrons 102 would then be overlaid the apex 13. Support chevrons 102 are formed from a portion of rafters 12 and comprise two leg portions 104 and 106, whose width is identical to the width of web 22 of rafters 12. Formed at the juncture of leg 104 and 106 is an aperture 38, identical to apertures 38 formed in rafters 12 and ceiling beam 16. Legs 104 and 106 each terminate with a portion of flange 24. It can be seen that chevrons 102 are formed by making two "V" cuts in a standard rafter 12. Support chevron 102 is positioned on both sides of the apex, and snap fit into apex flush with opposing sides of webs of the rafters 12. Fastening means 88 is then secured through the apertures 38 in the support chevrons 102 and the aperture 100 formed by the juncture of the adjoining rafters 12 at apex 13.

Having considered Applicant's method of fabrication, it will be recognized by one skilled in the art that oftentimes, in a roof truss, a collar beam is utilized for additional support. A collar beam being a beam that is parallel to the ceiling beam, but positioned approximately two-thirds of the distance up from the ceiling beam to the apex. Such collar beam, while not shown, would be secured to the roof rafters in a manner identical to the manner in which the roof rafters and the ceiling beam are secured at end 16.

Additionally, it will be recognized by those skilled in the trade that the sidewalls of the house are in communication with the ceiling beams and roof rafters. As such, in the fabrication of the roof rafters, a cut must be made in the flange of the roof rafter just below the point at which the ceiling beam will interconnect with the roof rafter. This cut 110 is illustrated in FIG. 1 and is an angular cut forming a 90° angle so that the ceiling beam and roof rafter can sit flush with the sidewall structural elements of the building.

FIG. 4 was a cross-sectional view of a typical rafter or ceiling beam in a secured mode. While it has been shown secured through the use of pin 36, positioned spacially along the web 22, it would be possible that the two sections of rafter 12 or ceiling beam 18 could be secured by a crimping tool, adhesive, screws or rivets.

Figure 14:
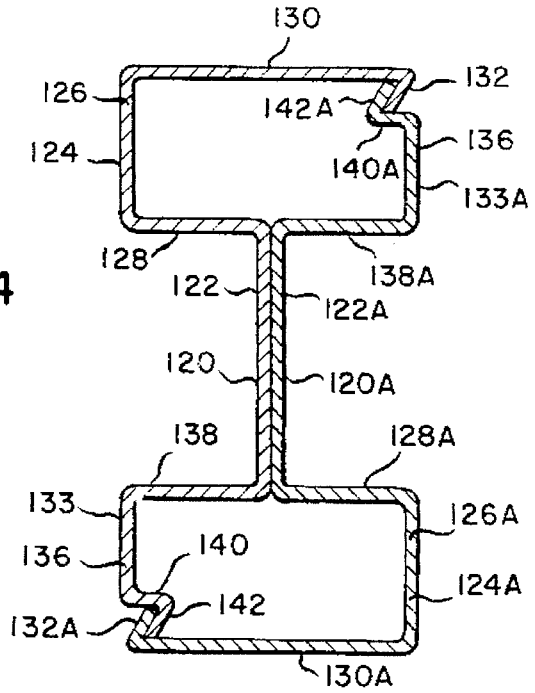
FIG. 14 is a cross-sectional view of two structural members and their manner of interlocking to form an "I" beam.

It will be noted again, with reference to FIG. 4, that the secured rafter or ceiling beam presents a surface 112 for receipt of overlying roof sheathing for exterior coverage of the roof trusses or overlying gypsum board or plaster board for the interior ceiling of the structure. It would be desirable that the fasteners utilized to secure the roof sheathing exteriorly or the gypsum or plaster board interiorly avoid being placed such that they enter the ceiling beam or roof rafter at the point where lips 32 adjoin. An experienced contractor will recognize this fact and align the fasteners accordingly. However, this problem can be eliminated by the use of-structural members having a cross-section different from that previously disclosed. FIG. 14 is a cross-sectional view of an "I" beam formed by two identical interlocking structural elements 120 and 120A. These structural elements consist of webs 122 and 122A having a first end flange 124 and 124A projecting laterally to one side of the web. They are generally rectangular and are opened to the opposite side of the web. Each rectangular flange 124 and 124A includes a bottom wall or base wall 126 and 126A positioned in parallel alignment with the web. The base is connected to the longitudinal edge of the web by an inner sidewall 128 and 128A, which is normal to the plane of the web. A second outer sidewall 130 and 130A is positioned in parallel alignment with the inner sidewall and extends beyond the plane of the web and terminates with a lip 132 and 132A which is angled acutely with outer sidewall 130 and 130A, respectively. A second flange 133 and 133A extend from opposing edges of the web and include a bottom wall or base 136 and 136A, which is in parallel alignment with the web, the base connected to the longitudinal edge of the web by means of inner sidewall 138 and 138A, respectively, which are normal to the plane of the web. A second outer sidewall 140 and 140A, respectively, depends from the outer edge of the base 136 and 136A, respectively normal to the web, but does not extend beyond the plane of the web. Outer sidewall 140 and 140A terminates lip 142 ad 142A, which is angled acutely with outer sidewall 140 ad 140A, respectively, and is angled outwardly from outer sidewall 140 and 140A, respectively.

In the foregoing configuration, it can be seen that the two identical structural members 120 and 120A may be snap fit together or slidably engaged with each other to form an "I" beam construction as described previously. All connections and fabrications previously discussed could be accomplished with the "I" beam construction as illustrated in FIG.

14. The advantage of the "I" beam construction in FIG. 14 is that it eliminates the convergence of lips 32 in the original "I" beam construction midway on the surface into which fasteners may be secured. In the configuration as illustrated in FIG. 14, the contractor is now provided with an uninterrupted surface for fasteners defined by outer sidewall 130 and 130A, respectively.

While this invention has been described in reference to the disclosure herein set forth, it is not necessarily limited to this particular embodiment and the application is intended to cover any adaptations or changes as may come within the scope of the present invention.

What is claimed is:

1. A metal roof support structure comprising:

a pair of rafter beams, each comprised of two complimentary rafter members, each of-said rafter members having a central web and a pair of flanges formed On each edge of said web, said web having a plurality of apertures positioned therethrough, alignable with said apertures in said complimentary rafter member, said rafter members positioned and secured in web to web relationship to form said rafter beam, said rafter beams having a first end angularly cut through said web and said flanges and through one of said apertures in said web so as to form an apex of said roof support, said degree of angularity in said cut, dependent upon the desired pitch of said roof;

a ceiling beam comprised of two complimentary ceiling members, each having a central web and pair of flanges formed on each edge of said web, said web having a plurality of apertures positioned along its length, alignable with said apertures in said complimentary ceiling member, each of said ceiling members having angular end cuts conforming to the pitch of said roof, each of said ceiling members having an angular channel cut in said web and a portion of said flange, internal of said angular end cuts defining a tip end of said ceiling member comprised of a portion of said web and said flanges including one of said apertures in said web of said ceiling member, said tip end of said ceiling members snap fit and interlocked over said rafter beam from opposing sides and alignable with one of said apertures in said web of said rafter beam;

an apex support comprised of two chevron members having a web portion and a pair of flanges formed on each edge of said web, said web angularly cut to conform to said apex formed by said rafter beams, said chevron dimensioned to snap fit into said adjoining webs of said rafter beams from opposing sides, said chevrons having an aperture in said web alignable with said aperture formed at said apex by said rafter beams;

internal supports interconnecting with said rafter beams and said ceiling beams, said internal supports having a web portion and a flange formed along one edge of said web, said web having an aperture therethrough adjacent the ends of said web;

a means for securing said rafter beam to said ceiling beam and said rafter beam to said rafter beam and said internal supports to said ceiling beam and said rafter beams, comprising a plug having a diameter equal to said apertures in said web of said ceiling beam and said rafter beam, said plug having at least one threaded end for receipt of a threaded fastener;

a securing means positionable along said web of said ceiling beam and along said web of said rafter beams to maintain said ceiling members and said rafter members comprising said ceiling beam and said rafter beams in said web to web relationship.

2. The metal roof support structure in accordance with claim 1 wherein said rafter members comprise a central web and a pair of flanges formed on each edge of said web, said flanges comprising an internal sidewall perpendicular to said web and an external sidewall perpendicular to the plane of said web, a base wall co-joining said internal sidewall and external sidewall and parallel to said plane of said web.

3. The metal support structure in accordance with claim 1 wherein said ceiling beam member comprises a central web and a pair of flanges formed on each edge of said web, said flanges comprising an internal sidewall perpendicular to said web and an external sidewall perpendicular to the plane of said web, and a base wall co-joining said internal sidewall and external sidewall and parallel to said plane of said web.

4. The metal roof support structure in accordance with claim 1 wherein said internal support comprises a king post comprised of two king post members, each of said king post members having a central web and a pair of flanges formed on each edge of said web, said king post having a first end cooperable with said ceiling beam, said first end of said king post having a channel cut through said flanges of said king post, said channel cooperable with one of said flanges of said ceiling beam to snap fit said two king post members to said web of said ceiling beam from opposing sides of said ceiling beam, said first end of said king post members having an aperture therethrough cooperable with said apertures in said web of said ceiling beam, said king post having a second end, angularly cut in the form of said chevron, dimensioned to snap fit into said adjoining web of said rafter beams from opposing sides, said web of said king post at said second end having an aperture alignable with said aperture in said apex of said adjoining rafter beams for receipt of said plug.

5. The metal roof support structure in accordance with claim 1 wherein said internal support comprises a plurality of struts interconnecting between said rafter beams and said ceiling beams, said struts, each comprising two strut members having a first end and a second end, each of said strut members having a web portion and one flange portion formed along one edge of said web, said first and said second ends of said strut members being angularly cut dependent upon the pitch of the roof, said first and second ends of said strut members having an angular channel cut through said web and a portion-of said flange internally from said first end and said second end, and parallel to said respective first angular end or cut said second angular end cut, said channel cuts defining portions of said strut member cooperable with said web of said ceiling beam and said web of said rafter beam to snap fit and interlock into said web of said ceiling beam or said rafter beam, said portion of said strut member having an aperture positioned therethrough, alignable and cooperable with said apertures on said webs of said rafter beam and said ceiling beam, respectively for receipt of said plug.

6. The metal roof support structure in accordance with claim 5 wherein said flange portion of said strut members comprises an internal wall perpendicular to said web, an external wall perpendicular to the plane of said web, and a base wall parallel to said plane of said web and interconnecting said internal wall and said external wall.

7. The metal roof support structure in accordance with claim 1 wherein said rafter member comprises a central web and a first flange and second flange formed on each longitudinal edge of said web, said flanges depending from said web in the same direction, said first flange comprising an internal wall perpendicular to said web, an external wall perpendicular to said plane of said web and extending beyond the plane of said web, a base wall parallel to said plane of said web and interconnecting said internal wall and said external wall, an angular lip, formed on the end of said external wall and angled towards said plane of said web, said second flange comprising an internal wall perpendicular to said web, an external wall perpendicular to said plane of said web, but not breaking said plane of said web, a base wall parallel to said plane of said web and interconnecting said internal wall and said exterior walls an angular lip formed on the end of said external wall and angled away from said plane of said web.

8. A kit for assembling a metal roof support structure of predetermined span and predetermined pitch comprising:

a pair of precut ceiling members complimentary to form a ceiling beam, each ceiling member having a central web and a pair of flanges formed on each edge of said web, said web having a plurality of apertures positioned along its length, alignable with said apertures and said complimentary ceiling member, each of said ceiling members having precut angular end cuts adapted to conform to the pitch of said roof, each of said ceiling members having an angular channel cut in said web and a portion of said flange, internal of said angular end cuts defining a tip end of said ceiling member comprising a portion of said web and said flanges including one of said apertures in said web of said ceiling member;

two pair of complimentary rafter members, each of said complimentary rafter members having a central web and a pair of flanges formed on each edge of said web, said web having a plurality of apertures positioned therethrough, alignable with apertures in one of said said complimentary rafter member, said rafter members positioned and secured in web-to-web relationship to form rafter beams, said rafter beams having a first end angularly cut through said web and said flanges and through one of said apertures in said web so as to form an apex of said roof support, said cut through said web and said flanges being precut to the predetermined pitch of said roof;

an apex support comprised of two chevron members having a web portion and a pair of flanges formed on each edge of said web, said web angularly cut to conform to said apex formed by said rafter beams, said chevron members dimensioned to snap fit into said adjoining webs of said rafter beams from opposing sides, said chevron members having an aperture in said web alignable with said aperture formed at said apex of said rafter beams;

a means for securing said rafter beams to said ceiling beam and one of said said rafter beams to the other of said rafter beams comprising a plug having a diameter equal to said apertures in said web of said ceiling beam and said rafter beams said plug having at least one threaded end for receipt of a threaded fastener, said ceiling beam members being adapted to snap fit and interlocked from opposing sides of said rafter beams and secured by said plug;

a securing means positionable along said web of said ceiling beam and along said web of said rafter beams to maintain said ceiling members and said rafter members comprising said ceiling beam and said rafter beams in web-to-web relationship.

9. The kit for assembling a metal roof support structure in accordance with claim 8, further comprising internal supports for interconnecting said rafter beams and said ceiling beams, said internal supports each comprising two complimentary members, each having a first end and a second end, each of said complimentary members having a web portion and one flange portion formed along one edge of said web portion, said first and said second end of said internal support members being angularly cut to the predetermined pitch of said roof, said first end and said second end of said internal support members having an angular channel cut through said web and a portion of said flange internally from said first end and said second end and parallel to said respective first end and/or said second end angular cuts, said channel cut defining a portion of said strut member cooperable with said web of said ceiling beam and said web of said rafter beam to snap it and interlock into said web of said ceiling beam or said rafter beam, said portion of said internal support member having an aperture positioned therethrough, alignable and cooperable with said apertures on said webs of said rafter beam and said ceiling beam, respectively, for receipt of a securing means.

* * * * *

UNITED STATES PATENT AND TRADEMARK OFFICE

CERTIFICATE OF CORRECTION

PATENT NO. : 5,542,227
DATED : August 6, 1996
INVENTOR(S) : Anthony M. Mercuro

It is certified that error appears in the above-identified patent and that said Letters Patent is hereby corrected as shown below:

Title page, item [76] inventor: should read -- Anthony M. Mercuro--.

Signed and Sealed this

Twenty-ninth Day of October 1996

*Attest:*

Bruce Lehman

BRUCE LEHMAN

*Attesting Officer*

*Commissioner of Patents and Trademarks*